US007387562B1

(12) United States Patent
Blum

(10) Patent No.: US 7,387,562 B1
(45) Date of Patent: Jun. 17, 2008

(54) BLADE SHARPENING DEVICE

(76) Inventor: Gary Joseph Blum, 212 Pearl St., Walnut, IA (US) 51577

( * ) Notice: Subject to any disclaimer, the term of this patent is extended or adjusted under 35 U.S.C. 154(b) by 0 days.

(21) Appl. No.: 11/696,211

(22) Filed: Apr. 4, 2007

(51) Int. Cl.
*B24B 1/00* (2006.01)
*B24B 19/00* (2006.01)

(52) U.S. Cl. ..... 451/45; 451/44; 451/380; 451/387

(58) Field of Classification Search ..... 451/45, 451/44, 367, 371, 378, 380, 386, 387, 404, 451/405
See application file for complete search history.

(56) References Cited

U.S. PATENT DOCUMENTS 1,086,239 A * 2/1914 Stover ..... 451/369
2,372,121 A * 3/1945 Rosenberg ..... 451/324
2,572,261 A * 10/1951 Hardey ..... 451/378
4,404,873 A 9/1983 Radish
4,964,241 A 10/1990 Conklin
5,138,801 A 8/1992 Anthon et al.
5,195,275 A 3/1993 McLean
5,363,602 A 11/1994 Anthon et al.
5,431,068 A 7/1995 Alsch

FOREIGN PATENT DOCUMENTS

GB 2077155 A * 12/1981

* cited by examiner

*Primary Examiner*—Dung Van Nguyen
(74) *Attorney, Agent, or Firm*—McKee, Voorhees & Sease, PL.C.

(57) ABSTRACT

A blade sharpening device is provided for honing a cutting edge of a blade. The device includes a block with a top honing surface, and a jig assembly mounted on the block. The jig assembly holds a blade in a fixed position adjacent the honing surface, and directed towards the honing surface, so that a sharpening stone can be manually moved on the top honing surface and across the blade edge for sharpening. The stone can be moved longitudinally, laterally, and circularly. The jig assembly is pivotally mounted on the block for a desired sharpening angle, and vertically adjustable so that the blade edge is substantially flush with the top honing surface of the block.

18 Claims, 4 Drawing Sheets

BLADE SHARPENING DEVICE

FIELD OF THE INVENTION

This invention relates to a device for sharpening blades of cutting tools using a whetstone, and particularly a jig for holding various woodworking edge tools, such as planes, chisels, scrapers, and the like.

BACKGROUND OF THE INVENTION

Cutting tools require a sharp edge to function satisfactorily and efficiently. Typically, the tool blade has a beveled cutting edge defined by two intersecting angles. The more refined or smoother the angle intersection can be made, the sharper the tool will be. Also, the more consistently that the angle can be made from one sharpening operation to the next sharpening operation, then the faster the desired edge can be obtained. A sharpening jig aids in setting the angle of the beveled edge repeatedly and accurately each time the blade is sharpened.

Prior art sharpening jigs are typically slow to set up or cumbersome to use. Prior art jigs usually have no provision or accommodation for setting the angle, except by using a separate angle measuring device. Using the blade jig in combination with the separate angle registration device takes time, and is prone to error. It is also awkward and difficult to secure the tool blade on the jig at the desired angle in many prior art sharpening devices.

It is normally desirable to hone both the beveled edge of the blade and the back side of the blade. However, with prior art jigs, only a small portion of the back side of the blade normally projects from the jig. Therefore, only a small portion of the back side of the blade which protrudes from the jig can be polished with the sharpening stone. For short bladed tools, the typical jig does not work, because the tool handle prevents the blade from protruding sufficiently so as to hone the required angle.

Some jigs utilize a roller which rolls on the sharpening stone while the blade is being honed. The distance from this roller to the blade edge may be long, depending on the bevel angle, which thus requires the sharpening stone to be longer than would otherwise be necessary so that the roller remains on the stone during the sharpening process.

Therefore, a primary objective of the present invention is the provision of an improved blade sharpening device.

Another objective of the present invention is the provision of a blade sharpening device which fixes the tool blade in a stationary position while the sharpening stone moves over the blade.

Still another objective of the present invention is the provision of a blade sharpening device having a scale for directly setting the honing angle.

Yet another objective of the present invention is a blade sharpening device having an unobstructed upper surface along which the sharpening stone moves over a blade edge in lateral, longitudinal, and/or circular motions.

A further objective of the present invention is the provision of a blade sharpening device which minimizes the sharpening stone size.

Another objective of the present invention is the provision of a blade sharpening device wherein the blade is referenced on its back side, with the beveled edge facing upwardly.

Still another objective of the present invention is the provision of a blade sharpening device having improved visibility during the sharpening process.

Still another objective of the present invention is the provision of a blade sharpening device which can hone both angled and straight blade edges.

A further objective of the present invention is the provision of a blade sharpening device which can be used for very small blades.

Yet another objective of the present invention is the provision of a blade sharpening device having an internal storage compartment for sharpening stones and other accessories.

Another objective of the present invention is the provision of an improved blade sharpening device which can sharpen blades repeatedly and accurately.

Still another objective of the present invention is the provision of a blade sharpening device which can be used to sharpen scraper blades at true 90° angles.

A further objective of the present invention is the provision of a blade sharpening device having a waterproof jig for water-stone sharpening.

Another objective of the present invention is the provision of an improved blade sharpening device which is economical to manufacture, and durable and efficient in use.

These and other objectives will become apparent from the following description of the invention.

BRIEF SUMMARY OF THE INVENTION

The blade sharpening device of the present invention includes a block with opposite first and second ends, opposite sides, and a top surface. A jig assembly is amounted in one end of the block and is adapted to hold various blades to be sharpened in a fixed position, with the edge of the blade being adjacent to and substantially flush with the top surface of the block. A sharpening stone is slid manually along the top surface of the block in longitudinal, lateral, and/or circular motions over the blade, so as to the sharpen cutting edge of the blade.

The jig assembly is pivotally mounted on the block such that the angle of the blade relative to the top surface of the block is adjustable. The jig is also vertically adjustable relative to the top surface of the block so that the blade is substantially flush with the top surface. A scale is provided on the block, with a pointer connected to the jig assembly to directly indicate on the scale the angle of the jig. A second jig assembly may be provided on the block to hold a scraper blade for sharpening the blade edge at a 90° angle. The block is hollow so as to define a storage compartment therein for storing sharpening stones and other accessories.

The method of sharpening a blade using the device of the present invention comprises the steps of fixing the blade in the jig so as to be stationary with the edge of the blade facing the top support surface of the block, manually gripping a sharpening stone in a user's hand, and moving the sharpening stone along the support surface so as to hone the edge of the blade.

DETAILED DESCRIPTION OF THE PREFERRED EMBODIMENT

Figure 1:
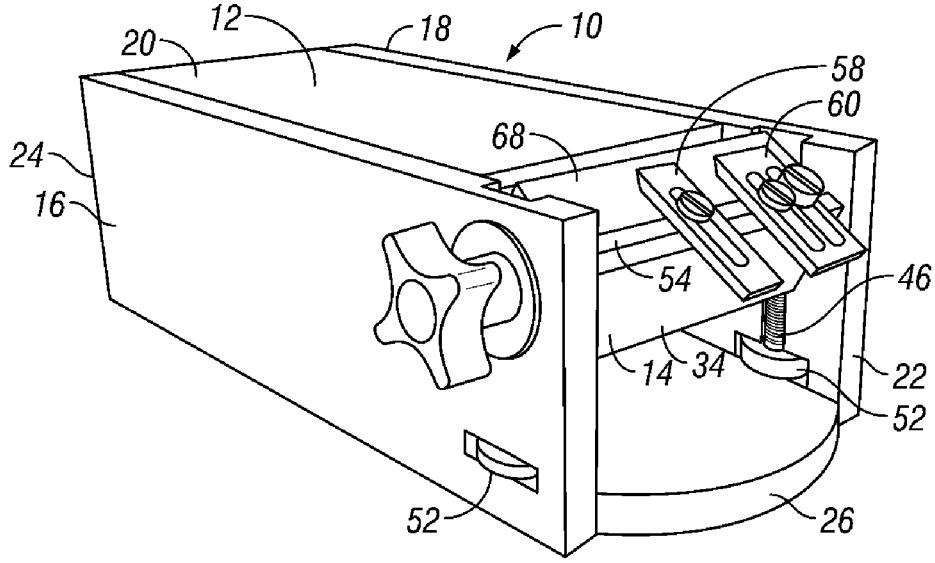
FIG. 1 is a perspective view of the blade sharpening device of the present invention.

The blade sharpening device of the present invention is designated by the reference numeral 10 in the drawings. The device 10 generally comprises a block 12 and a jig assembly 14 mounted to the block.

Figure 3:
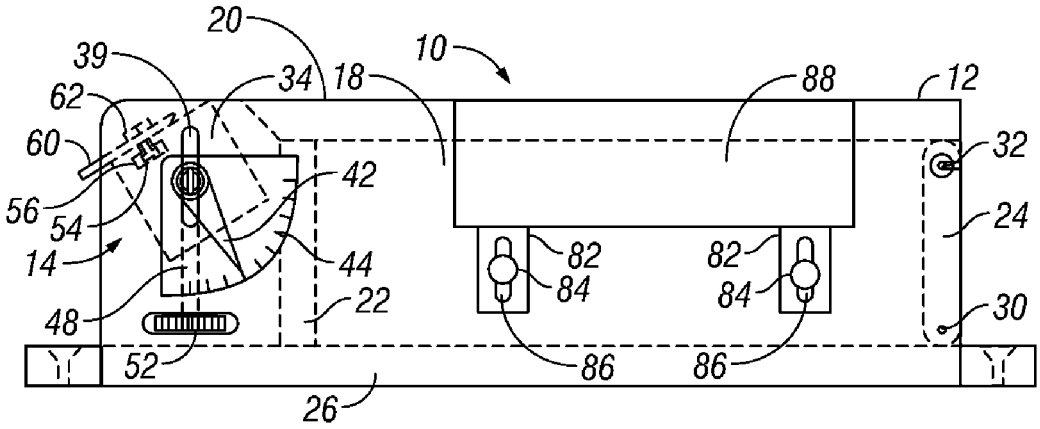
FIG. 3 is a side elevation view of the device.

The block 12 includes opposite sides 16, 18, a top surface 20, and opposite ends 22, 24. Preferably, a bottom 26 is also provided on the block 12. Preferably, the block 12 is hollow, with the front end 22 comprising a wall and the rear end 24 comprising a door so as to define an internal storage compartment 28 for storing sharpening stones, extra blades, and other accessories. The door 24 may be pivotally connected to the block 12 in any convenient manner so as to be moveable between open and closed positions to provide access to the storage compartment 28. For example, as seen in FIG. 3, the door 24 is mounted to the block 12 by a pivot pin 30 and is retained in a closed position via the pressure of a thumb screw 32. It is understood that the door 24 can also be hinged to the block 12 and have any conventional latch or lock mechanism to maintain the door in the closed position.

Figure 4:
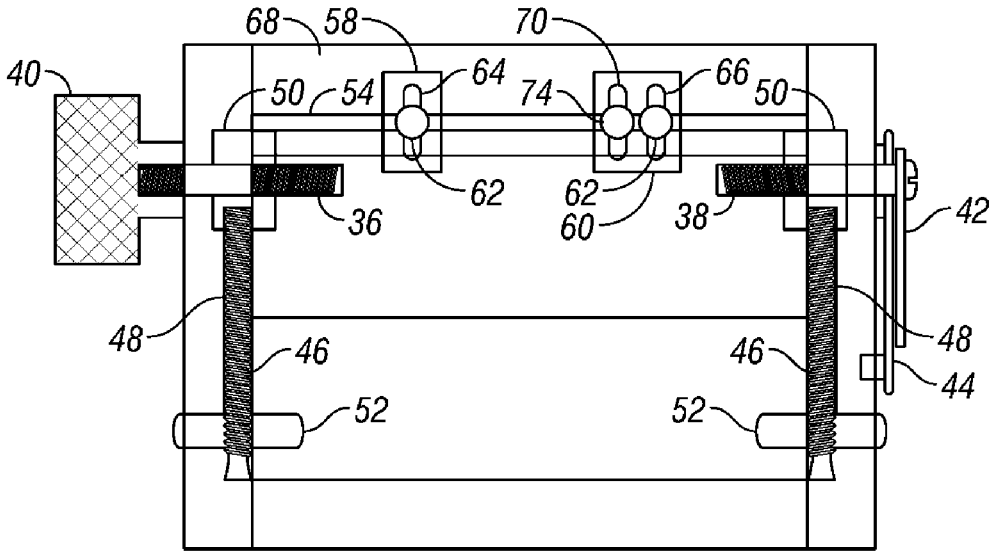
FIG. 4 is an end elevation view of the device.
Figure 5:
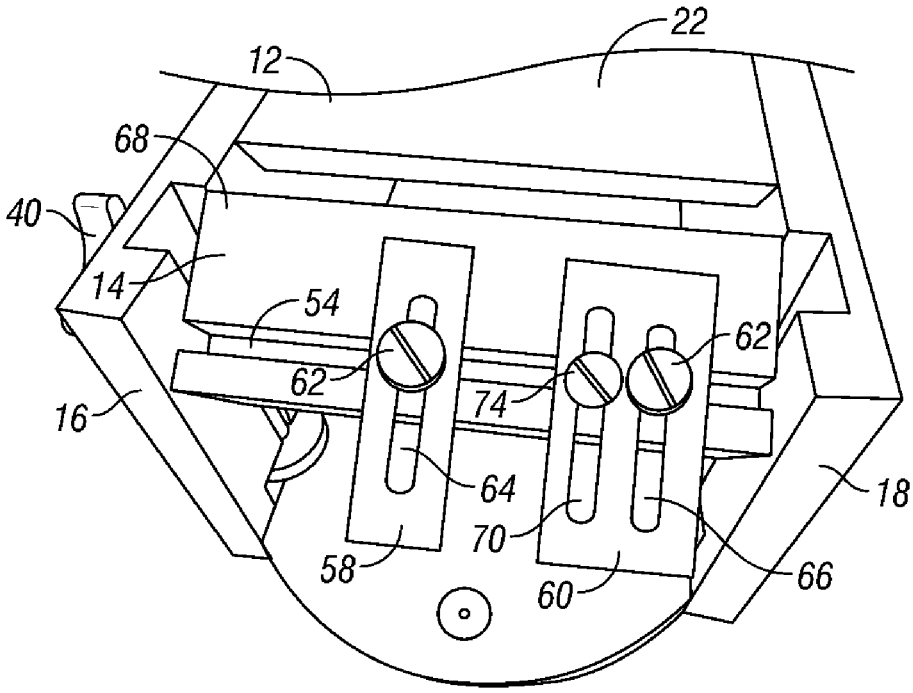
FIG. 5 is an enlarged perspective view of the jig assembly of the device.
Figure 6:
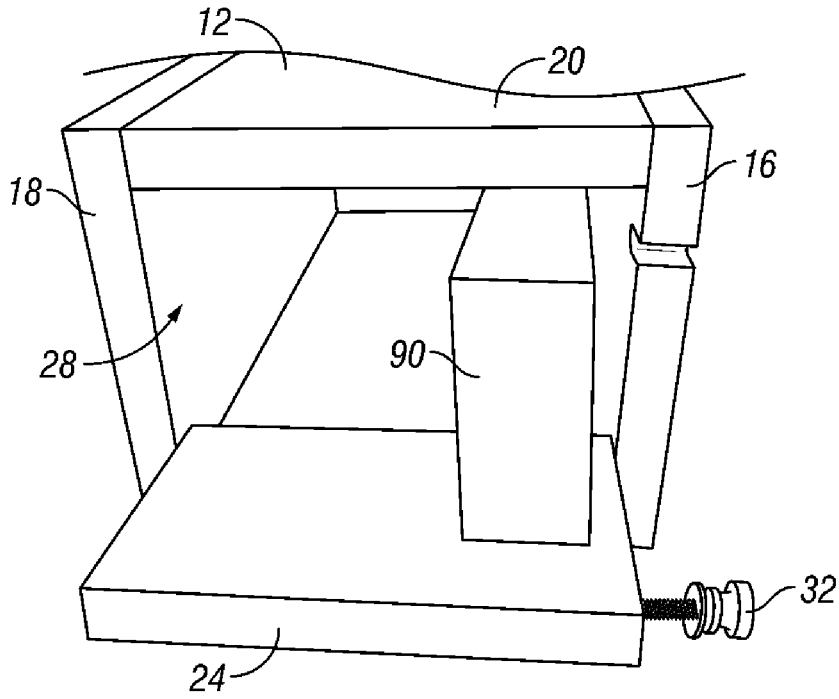
FIG. 6 is a view from an opposite end showing the internal storage compartment of the device.

The jig assembly 14 includes a jig body 34 which is pivotally mounted between the left and right sides 16, 18 of the block 12 on a pivot axis defined by axles 36, 38 extending from opposite sides of the body 34, as best seen in FIG. 4. While FIG. 4 shows the axles 36, 38 to be separate, it is understood that a single, elongated axle can extend through the length of the body 34, as opposed to separate axles. The left axle 36 extends outwardly beyond the left side wall 16. A clamping knob 40 is threadably mounted on the outer end of the axle 36. The knob 40 can be loosened to allow pivotal rotation of the jig body 34, and can be tightened so as to fix the jig body 34 in a selected angular position.

The right axle 38 extends outwardly beyond the right side wall 18, and has a pointer 42 attached to the outer end of the axle 38. A scale 44 is secured in any convenient manner to the right side wall 18 of the block 12 and includes angular indices corresponding to the angular orientation of the jig body 34. Thus, as the body 34 is pivoted about the axles 36, 38, the pointer 42 directly indicates on the scale 44 the angular orientation of the jig body 34.

The jig body 34 is also vertically adjustable relative to the top surface 20 of the block 12. More particularly a pair of threaded posts or shafts 46 are mounted in grooves 48 on the inside of the side walls 16, 18, as best seen in FIG. 4. At the top of each post 46 is a shaft collar 50 with a bushing through which the axles 36, 38 extend. The bottom of each post 46 is threadably received in a wheel 52. The shaft collars 50 do not rotate, but are free to slide along the enlarged upper end of the grooves 48, thereby allowing the axles 36, 38 and the jig body 34 to be adjusted upwardly and downwardly along the axle slots 39 in the block side walls 16, 18 as the wheels 52 are rotated.

Figure 2:
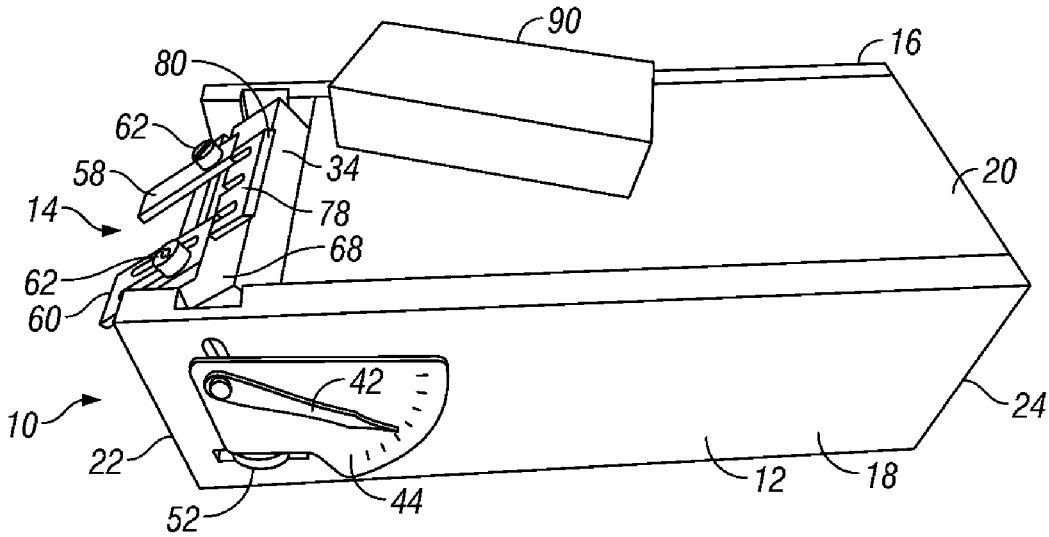
FIG. 2 is another perspective view of the blade sharpening device.
Figure 7:
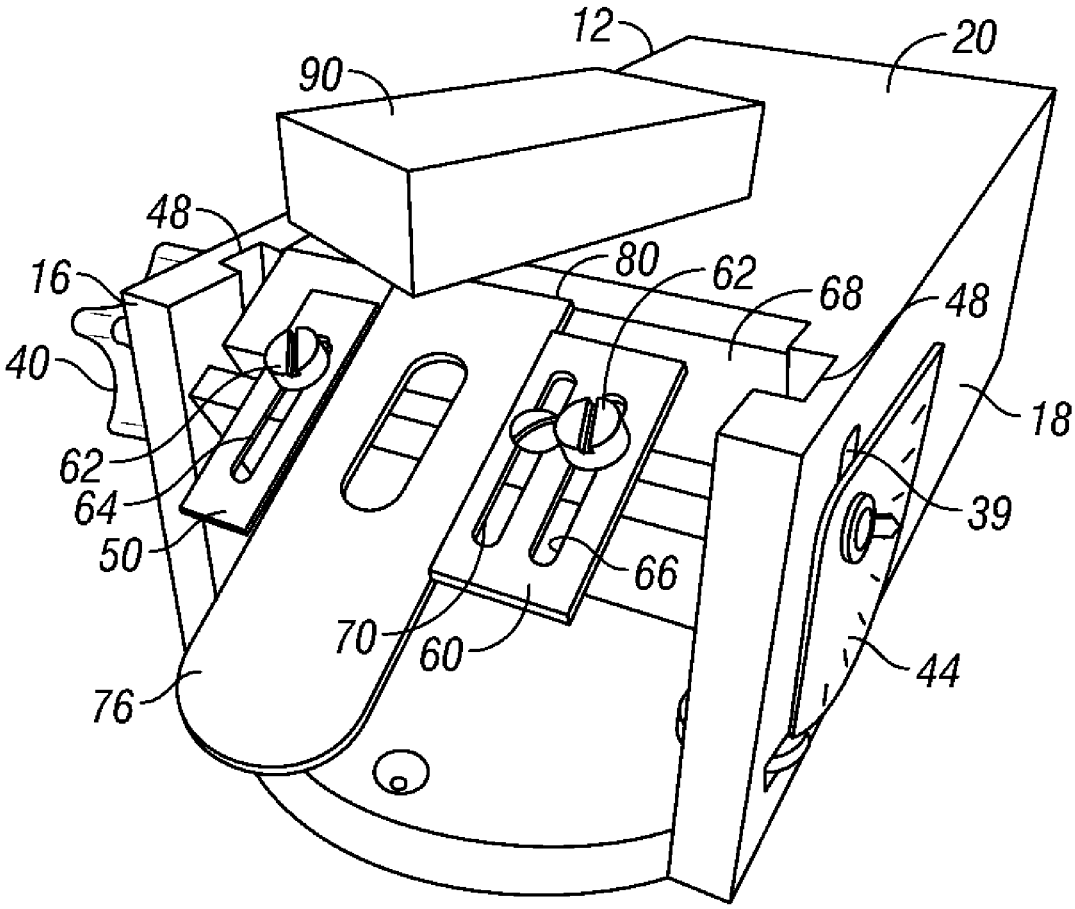
FIG. 7 is another perspective view of the device showing a blade from a plane secured to the jig for sharpening.

The jig body 34 includes a T-shaped slot 54 extending across the width of the body. A pair of nuts 56 are retained within the T-shaped slot 54. A pair of blade stops 58, 60 are mounted on the jig body 34 by bolts or thumb screws 62 extending through slots 64, 66 in the blade stops 58, 60, respectively and into the nuts 56 in the T slot 54. The blade stops 58, 60 are adapted to hold or clamp a blade to be sharpened on to the upper surface 68 of the jig body 34. A second slot 70 is provided on the blade stop 60 and has a countersink. A screw 74 with a countersink head extends through the slot 70 and into a nut in the T-slot 54. The T-slot 54 allows lateral adjustment of the space between the blade stops 58, 60, so as to accommodate blades 76 having different widths positioned between the blade stops 58, 60, as shown in FIG. 7. The screw 74 can be tightened with a screwdriver so that the countersink head of the screw 74 wedges the side of the blade stop 60 slightly outwardly so as to secure the blade 76 between the blade stops 58, 60. Thus, the male and female countersinks of the slot 70 and screw 74 have a wedging effect. When the screw 74 is released, the blade 76 can be removed from the jig body 34. The slots 64, 66 in the blade stops 58, 60 allow longitudinal adjustment of the blade stops, so as to accommodate smaller blades 78 to be positioned in front of the blade stops 58, 60 for sharpening, as shown in FIG. 2.

In use, the angle to be honed on the blade 76, 78 is set on the jig body 34 by loosening the lock knob 40, turning the body 34 to the desired angle as indicated by the pointer 42 on the scale 44, flushing the body 34 with the top honing surface 20 of the block 12 by turning the body height adjusting wheels 52 to move the body 34 upwardly or downwardly via the axle slots 39, and then tightening the knob 40. The blade 76, 78 is set onto to the upper surface 68 of the body 34 with the beveled side up so that the cutting edge 80 is directed towards the top surface 20 of the block 12. The blade edge 80 will be very slightly positioned above the honing surface 20. During an initial honing or sharpening procedure wherein a bevel may need to be re-made or increased honing pressure is necessary, the blade is preferably clamped between the blade stops 58, 60, and the outer thumb screws 62 tightened, as shown in FIG. 7. Then, the clamping screw 74 is tightened to further secure the blade between the stops 58, 60.

For subsequent honing with finer grit stones, it is unnecessary to clamp the blade between the stops 58, 60. Rather, the blade can be positioned between or in front of the stops 58, 60 and held by hand. This hand retention of the blade on the jig body 34 provides for fast and convenient "chasing of the wire edge" by flipping the blade between the beveled edge 80 and the back side. The blade is set on the top surface of the block 12 with the back side facing upwardly when the back side is being honed.

The stops 58, 60 have forward edges ground at a 45° angle, which allows short and/or thin blades to be positioned in front of the stops 58, 60, which are then adjusted forwardly and rearwardly via the slots 64, 66 and the thumb screws 62 so that the blade edge is substantially flush with the top surface 20 of the block 12 for sharpening. By capturing the rear of the short or thin blade 78 in the beveled front edge of the stops 58, 60, the blade is effectively held for honing, and is easily removed and repositioned.

One of the side walls 16, 18 of the block 12 has two additional blade stops 82 secured to the side wall with thumb screws 84 extending through slots 86 in the stops 82, and received in threaded inserts tapped into the side wall of the block 12. A scraper blade, also known as a card scraper, can be set in the blade stops 82, which are vertically adjusted via the slots 86, such that the edge of the scraper 88 is very slightly above the honing surface 20 of the block 12, so as to allow for quick and accurate sharpening of the scraper edge, and assuring a 90° angle on the edge.

The top honing surface 20 of the block 12 is free from obstructions, such that the sharpening stone 90 can be slid on the top surface 20 in a longitudinal motion, lateral motion, and/or circular motion on the surface 20 and across the blade edge 80 for sharpening.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A blade sharpening device for honing a cutting edge of a blade, comprising:

a block with opposite first and second ends, opposite sides, and a top surface;

a jig assembly mounted on the block and adapted to hold the blade in a fixed position with an edge of the blade being adjacent the top surface of the block;

a sharpening stone manually slidable on the top surface so as to sharpen the cutting edge of the blade; and the jig assembly being pivotally mounted on the first end of the block such that the angle of the blade relative to the top surface is adjustable.

2. The blade sharpening device of claim 1 wherein the jig assembly is vertically adjustable relative to the top surface so that the blade is positionable substantially flush with the top surface.

3. The blade sharpening device of claim 1 further comprising a scale on the block and a pointer connected to the jig assembly to indicate on the scale the angle of the blade.

4. A blade sharpening device for honing a cutting edge of a blade, comprising:

a block with opposite first and second ends, opposite sides, and a top surface;

a jig assembly mounted on the block and adapted to hold the blade in a fixed position with an edge of the blade being adjacent the top surface of the block;

a sharpening stone manually slidable on the top surface so as to sharpen the cutting edge of the blade; and the jig assembly being vertically adjustable relative to the top surface so that the blade is positionable substantially flush with the top surface.

5. A blade sharpening device for honing a cutting edge of a blade, comprising:

a block with opposite first and second ends, opposite sides, and a top surface;

a jig assembly mounted on the block and adapted to hold the blade in a fixed position with an edge of the blade being adjacent the top surface of the block;

a sharpening stone manually slidable on the top surface so as to sharpen the cutting edge of the blade; and a second jig assembly mounted on the block to hold a blade scraper in a vertical orientation with an edge of the scraper being substantially flush with the top surface of the block for sharpening by the stone sliding on the top surface.

6. The blade sharpening device of claim 5 wherein the second jib assembly is vertically adjustable.

7. A blade sharpening device for honing a cutting edge of a blade, comprising:

a block with opposite first and second ends, opposite sides, and a top surface;

a jig assembly mounted on the block and adapted to hold the blade in a fixed position with an edge of the blade being adjacent the top surface of the block;

a sharpening stone manually slidable on the top surface so as to sharpen the cutting edge of the blade; and the block being hollow so as to define a storage compartment therein.

8. The blade sharpening device of claim 1 wherein the top surface is free from obstructions so as to allow the stone to be moved in lateral, longitudinal and circular motions for sharpening the blade.

9. A method of sharpening a blade, comprising:

fixing the blade in a jig so as to be stationary, with an edge of the blade facing a support surface;

gripping a sharpening stone in a user's hand;

manually moving the sharpening stone along the support surface and across the blade edge so as to hone an edge of the blade;

adjusting the angle of the jig so that the blade edge is substantially flush with the support surface; and indicating on a scale the angular orientation of the jig.

10. A method of sharpening a blade, comprising:

fixing the blade in a jig so as to be stationary, with an edge of the blade facing a support surface;

gripping a sharpening stone in a user's hand;

manually moving the sharpening stone along the support surface and across the blade edge so as to hone an edge of the blade; and adjusting the height of the jig so that the blade edge is substantially flush with the support surface.

11. The method of claim 10 wherein the stone is moved laterally over the blade edge.

12. The method of claim 10 wherein the stone is moved longitudinally over the blade edge.

13. The method of claim 10 wherein the stone is moved circularly over the blade edge.

14. A device for sharpening an edge of a blade, comprising:

a block having a planar top surface to support a sharpening stone;

a jig on the block adapted to hold a blade adjacent the top surface with the blade edge being substantially flush with the top surface;

whereby the stone is slidable on the top surface and on the blade edge to sharpen the edge; and the jig being pivotally and vertically adjustable.

15. The device of claim 14 wherein the jig holds the blade with the edge directed toward the support surface.

16. The device of claim 14 wherein the support surface allows movement of the stone in any horizontal direction.

17. A device for sharpening an edge of a blade, comprising:

a block having a planar top surface to support a sharpening stone;

a jig on the block adapted to hold a blade adjacent the top surface with the blade edge being substantially flush with the top surface;

whereby the stone is slidable on the top surface and on the blade edge to sharpen the edge; and a scale on the block to indicate an angular orientation of the jig.

18. A device for sharpening an edge of a blade, comprising:

a block having a planar top surface to support a sharpening stone;

a jig on the block adapted to hold a blade adjacent the top surface with the blade edge being substantially flush with the top surface;

whereby the stone is slidable on the top surface and on the blade edge to sharpen the edge; and a storage compartment inside the block.

* * * * *